US005829640A

United States Patent [19]

Hershey et al.

[11] Patent Number: 5,829,640

[45] Date of Patent: Nov. 3, 1998

[54] DISPENSING PUMP

[75] Inventors: Donald E. Hershey; Eric R. Bartsch, both of Cincinnati, Ohio

[73] Assignee: The Procter & Gamble Company, Cincinnati, Ohio

[21] Appl. No.: 711,700

[22] Filed: Sep. 6, 1996

[51] Int. Cl.[6] ..... B67D 5/42

[52] U.S. Cl. ..... 222/153.13; 222/207; 222/375; 222/383.1; 222/384

[58] Field of Search ..... 222/153.13, 153.14, 222/207, 321.3, 321.7, 321.9, 375, 383.1, 384, 385

[56] References Cited

U.S. PATENT DOCUMENTS

| | | | |
|---|---|---|---|
| 2,943,771 | 7/1960 | Driscoll | 222/512 |
| 3,214,069 | 10/1965 | Dike | 222/498 |
| 3,263,874 | 8/1966 | Porter et al. | 222/498 |
| 4,046,292 | 9/1977 | Corsette | 222/383 |
| 4,218,198 | 8/1980 | Kutik et al. | 417/566 |
| 4,375,266 | 3/1983 | Magers | 222/321 |
| 4,396,132 | 8/1983 | Christensen | 222/1 |
| 4,410,107 | 10/1983 | Corsette | 222/153.13 X |
| 4,485,943 | 12/1984 | Czech | 222/256 |
| 4,500,016 | 2/1985 | Funfstuck | 222/153 |
| 4,505,400 | 3/1985 | Bennett | 215/250 |
| 4,511,065 | 4/1985 | Corsette | 222/153 |
| 4,512,501 | 4/1985 | Foster | 222/153 |
| 4,524,888 | 6/1985 | Tada | 222/153.13 X |
| 4,699,299 | 10/1987 | Gach | 222/480 |
| 4,848,595 | 7/1989 | Foster et al. | 222/153 |
| 4,863,070 | 9/1989 | Andris | 222/207 |
| 4,863,071 | 9/1989 | Guss et al. | 222/207 |
| 4,867,347 | 9/1989 | Wass et al. | 222/207 X |
| 4,869,404 | 9/1989 | Elliott | 222/385 |
| 4,915,601 | 4/1990 | Von Schuckmann | 222/207 X |
| 4,930,670 | 6/1990 | Kuo | 222/321 |
| 4,958,754 | 9/1990 | Dennis | 222/383 |
| 5,014,881 | 5/1991 | Andris | 222/207 |
| 5,016,783 | 5/1991 | Hayes et al. | 222/321 |
| 5,125,545 | 6/1992 | Passalacqua | 222/341 |
| 5,152,434 | 10/1992 | Birmelin | 222/207 |
| 5,181,635 | 1/1993 | Balderrama et al. | 222/383 |
| 5,381,932 | 1/1995 | Humphrey | 222/321 |
| 5,397,035 | 3/1995 | Law | 222/383 |
| 5,409,146 | 4/1995 | Hazard et al. | 222/321.8 |
| 5,490,615 | 2/1996 | Robbins et al. | 222/153.13 |
| 5,492,251 | 2/1996 | Albini et al. | 222/153.13 |
| 5,518,147 | 5/1996 | Peterson et al. | 222/207 X |
| 5,524,793 | 6/1996 | O'Neill | 222/153.13 |

FOREIGN PATENT DOCUMENTS

| | | |
|---|---|---|
| 8629681 | 3/1988 | Germany . |

*Primary Examiner*—Kenneth Bomberg
*Attorney, Agent, or Firm*—William Scott Andes

[57] ABSTRACT

A dispensing pump including an actuator coupled to a resilient bellow, wherein the bellow is in fluid communication with the contents of a container via an inlet valve. Expansion of the bellow, caused by the resilience of the bellow, creates negative pressure causing the contents of the container to be drawn through the inlet valve and into a space defined by the bellow. The dispensing pump also includes an outlet valve in fluid communication with the bellow such that compression of the bellow caused by the application of pressure to the actuator creates positive pressure within the bellow causing the contents held within the bellow to be forced through the outlet valve and out of an outlet of the dispensing pump.

20 Claims, 8 Drawing Sheets

DISPENSING PUMP

BACKGROUND OF THE INVENTION

1. Field of the Invention

The invention relates to a dispensing pump. More particularly, the invention relates to a bellowed dispensing pump including a closure mechanism and a child resistant safety lock.

2. Description of the Prior Art

Simple dispensing pumps have recently found widespread use in the packaging of liquid goods. These dispensing pumps rely upon pressure differences to draw fluid, or other materials, from a container in a convenient manner. Most prior dispensing pumps function by creating a negative pressure which draws the contents of a container through the dispensing pump and out an outlet nozzle. These dispensing pumps often rely upon a spring mechanism to create the negative pressure required to draw the fluid from within the container. This is an expensive, complicated mechanism, and substantially limits the volume of fluid that may be drawn through the dispensing pump with each stroke of the pump.

Others have attempted to increase the volume supplied with each stroke of the pump (that is, increase the dose) by expanding the diameter of the piston and body of a typical piston pump design. This approach is difficult. Specifically, as the parts become larger, it is difficult to maintain proper dimensional tolerance of the sliding seal on the piston. In addition, the amount of plastic used in molding becomes excessive. As a result, most dispensing pumps currently available are capable of dispensing only one ounce with each stroke of the dispensing pump. This becomes cumbersome when the consumer must pump a large quantity from the container.

In addition to the limited dose volumes provided by prior dispensing pumps, prior dispensing pumps utilize a spring to return the piston to an upward position, while the up and down movement of the piston creates the pressure necessary to draw the fluid from within the container. The provision of springs within these dispensing pumps makes the pumps more costly and unnecessarily complicated.

An additional problem common in dispensing pumps is the inability of most pumps to securely prevent the flow of liquid through the dispensing pump. This is especially problematic during shipping, where inadvertent movement of the container causes the stored fluid to move through, and out of, the dispensing pump. This discharge may be caused by a build up of pressure within the container, which forces the fluid through the dispensing pump, or movement of the piston which creates pressure within the container to force fluid through the dispensing pump.

Prior dispensing pumps have addressed these problems by providing a locking mechanism which locks the piston in a compressed position. By locking the piston in its downward compressed position, the piston is prevented from moving and creating pressure. Unfortunately, however, when the piston is locked in this position, the springs within the dispensing pump are also compressed. The permanent deformation of the springs, and other pump structures, is structurally detrimental.

Without an adequate locking structure for prior dispensing pumps which functions to lock a pump in its full extended position, the effectiveness of any child resistant lock incorporated with the locking mechanism is substantially limited in effectiveness and/or convenience.

After studying prior dispensing pumps, it is readily apparent that a need continues to exist for a convenient, reliable and inexpensive dispensing pump. The present invention provides such a dispensing pump.

SUMMARY OF THE INVENTION

It is, therefore, an object of the present invention to provide a dispensing pump. The dispensing pump includes an actuator coupled to a resilient bellow, wherein the bellow is in fluid communication with the contents of a container via an inlet valve. Expansion of the bellow, caused by the resilience of the bellow, creates negative pressure causing the contents of the container to be drawn through the inlet valve and into a space defined by the bellow. The dispensing pump also includes an outlet valve in fluid communication with the bellow such that compression of the bellow caused by the application of pressure to the actuator creates positive pressure within the bellow causing the contents held within the bellow to be forced through the outlet valve and out of an outlet of the dispensing pump.

It is also an object of the present invention to provide a dispensing pump wherein the inlet valve is a one-way valve permitting the flow of material from the container to the space defined by the bellow and preventing the flow of material from the space defined by the bellow to the container when positive pressure is applied to the bellow.

It is another object of the present invention to provide a dispensing pump wherein the outlet valve is a pressure responsive one-way valve permitting the flow of material from the space defined by the bellow through the outlet valve and to the outlet of the dispensing pump when a predetermined positive pressure is reached in the space defined by the bellow.

It is a further object of the present invention to provide a dispensing pump including a closure arm mounted within the space defined by the bellow. The closure arm is moveable between a first position where the closure arm prevents the inlet valve from opening and a second position where the closure arm is not a hinderance to the flow of material through the inlet valve.

It is also an object of the present invention to provide a dispensing pump wherein the closure arm is moved between the first position and the second position by rotating the pump dispenser.

It is another object of the present invention to provide a dispensing pump including a lock preventing movement of the closure arm between the first position and the second position.

It is a further object of the present invention to provide a container incorporating the dispensing pump discussed above.

It is also an object of the present invention to provide a dispensing pump including means for preventing downward movement of the actuator when the closure arm is in the first position.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as the basis for the claims and as a basis for teaching one skilled in the art how to make and/or use the invention.

Figure 1:
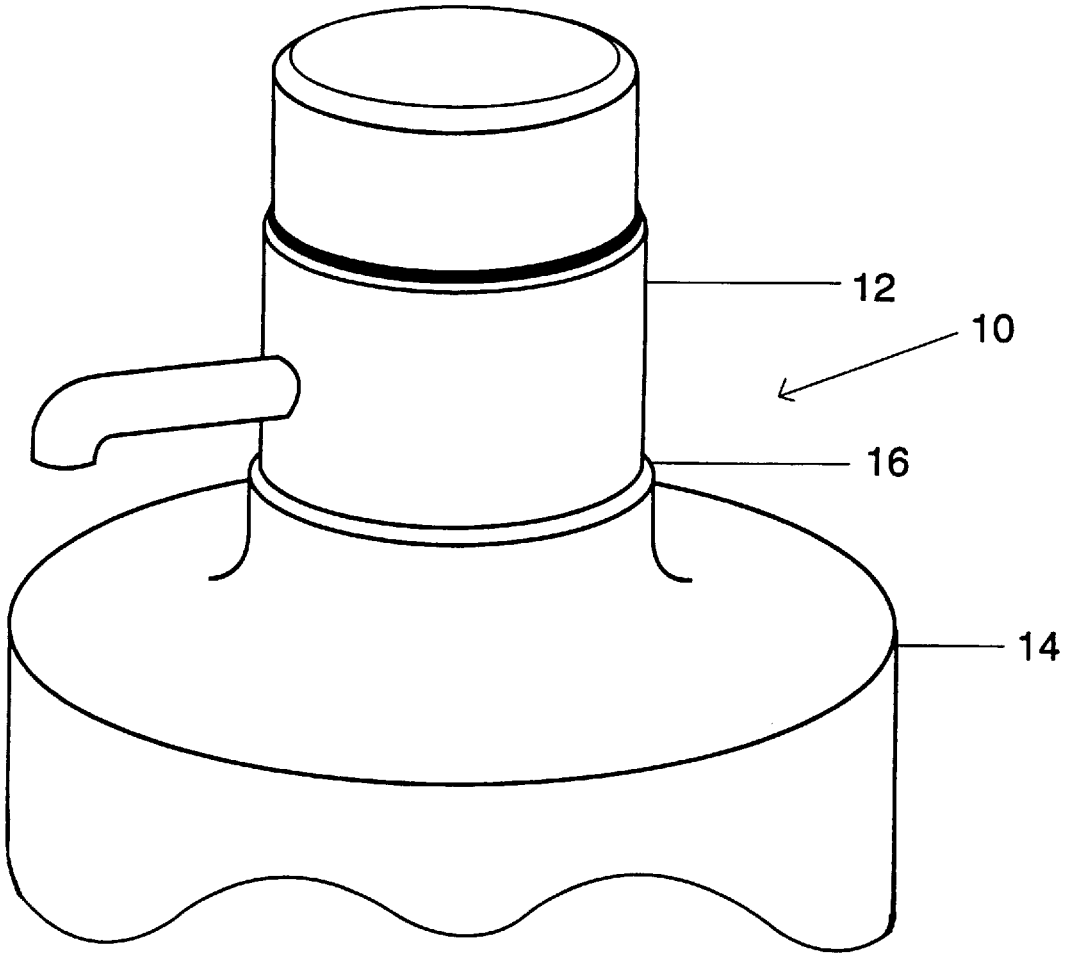
FIG. 1 is a perspective view of a container including the dispensing pump of the present invention.

With reference to FIG. 1, a container 10 including the present dispensing pump 12 is disclosed. The container 10 includes a body 14 for storing materials therein. The body 14 includes an open end 16 to which the dispensing pump 12 is secured. The dispensing pump 12 may be permanently secured to the open end 16 of the container body 14 or the dispensing pump 12 may be releasably secured to the open end 16 of the container body 14 by a threaded attachment, or some other conventional attachment structure permitting the selective release of the dispensing pump.

Figure 2:
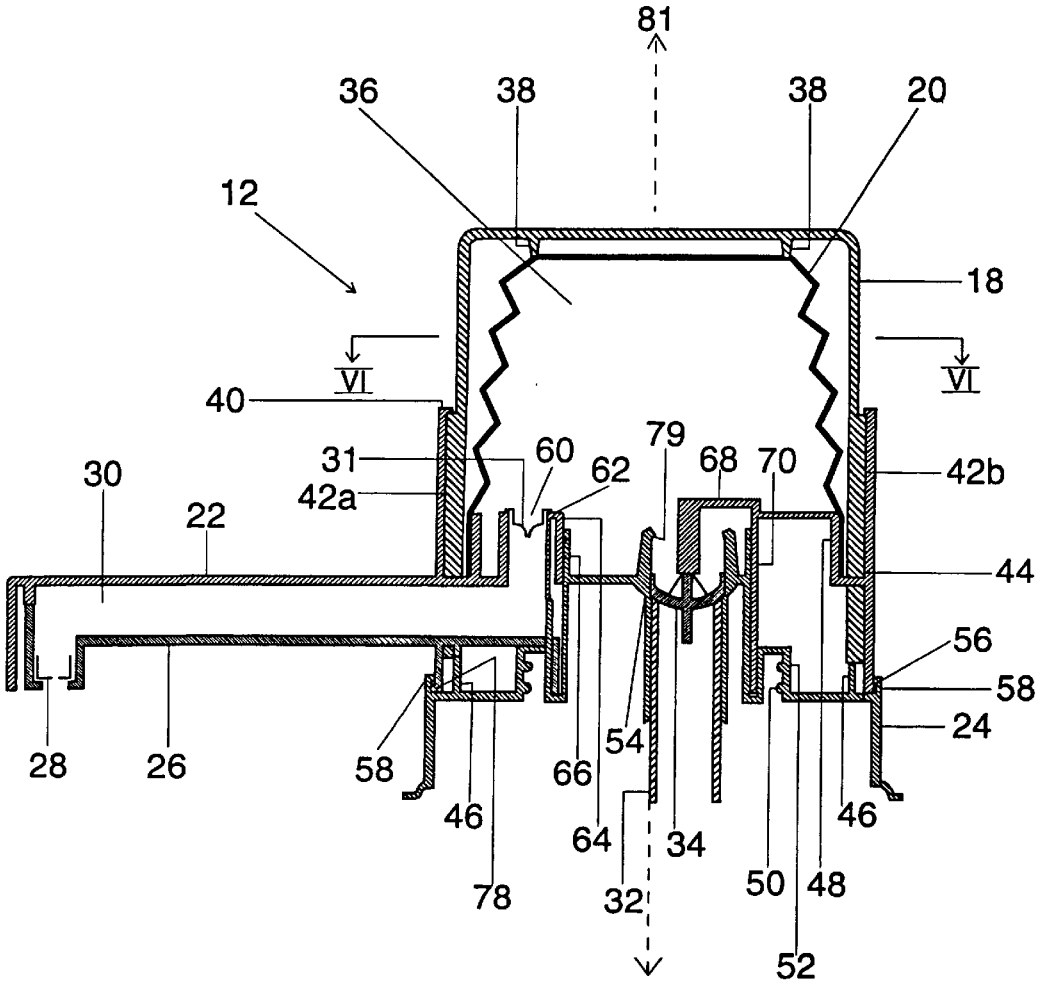
FIG. 2 is a cross-sectional view showing the dispensing pump in its up and locked position.

The dispensing pump 12 is shown in greater detail in FIG. 2, and includes an actuator 18 coupled to a resilient bellow 20. The dispensing pump 12 also includes an upper nozzle portion 22, a closure 24, a lower nozzle portion 26, a nozzle valve 28, an outlet channel 30, an outlet valve 31, a dip tube 32 and an inlet valve 34.

The bellow 20 is in fluid communication with the contents of the container via the dip tube 32 and the inlet valve 34 such that expansion of the bellow 20 creates negative pressure causing the contents of the container 10 to be drawn through the inlet valve 34 and into storage space 36 defined by the bellow 20. The bellow 20 is also in fluid communication with the nozzle valve 28 and the outlet valve 31 such that a compression of the bellow 20 caused by the application of pressure to the actuator 18 creates positive pressure within the bellow 20. The creation of positive pressure within the bellow 20 forces the fluid held within the storage space 36 defined by the bellow 20 through the outlet valve 31 and the nozzle valve 28, and out the outlet channel 30 of the dispensing pump 12.

The actuator 18 reacts against the bellow 20 via ribs 38 such that there is even pressure applied to the top pleat of the bellow 20. The actuator 18 and bellow 20 are substantially located within the upper nozzle portion 22. As such, the actuator 18 reacts against the upper nozzle portion bead 40 of the upper nozzle portion 22 to limit the upward movement of the actuator 18.

Figure 3:
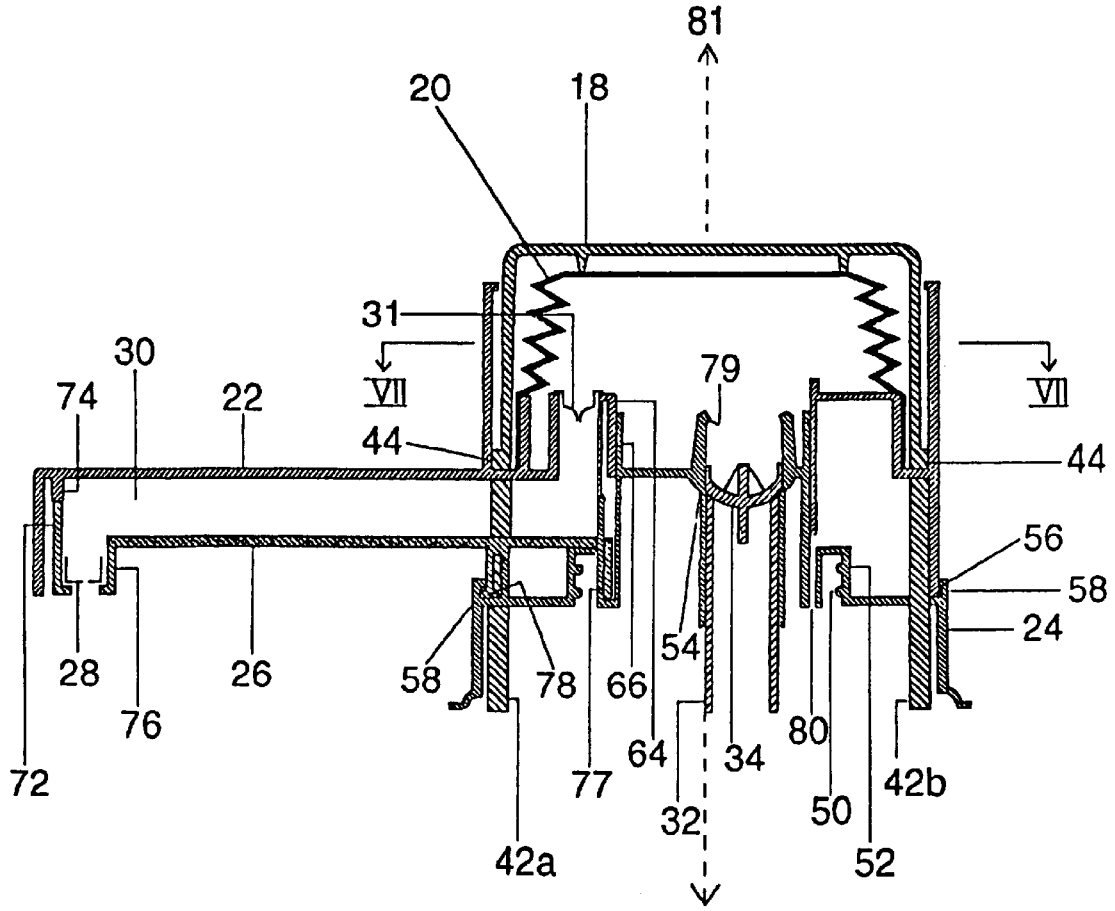
FIG. 3 is a cross-sectional view showing the dispensing pump in its down and open position.
Figure 4:
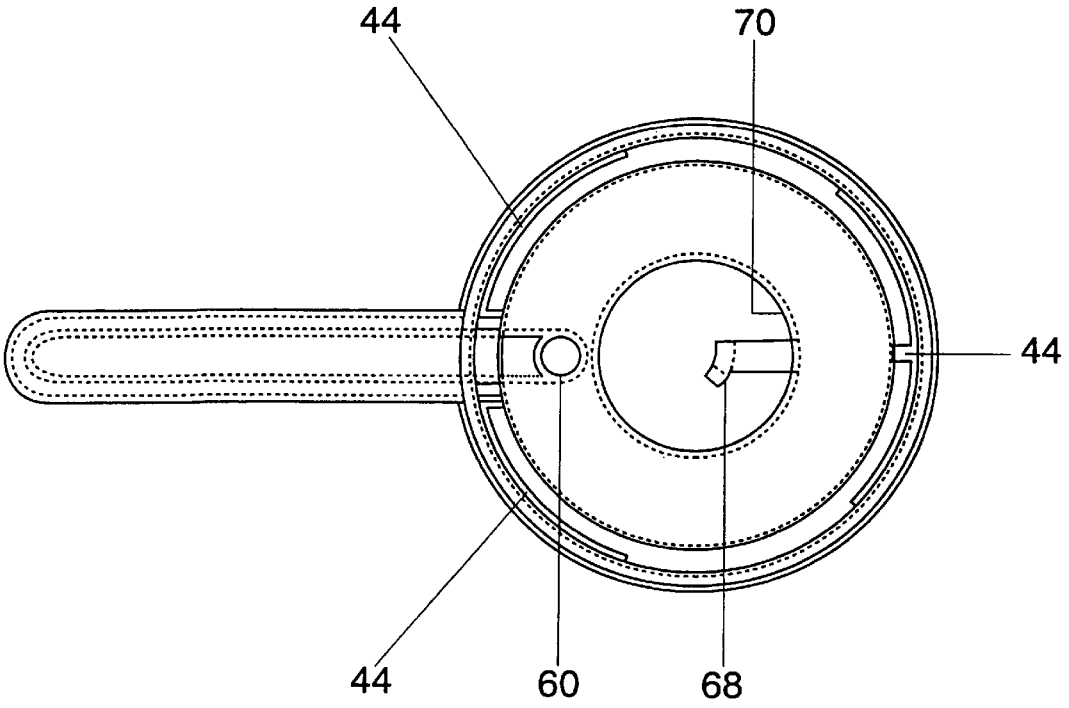
FIG. 4 is a top view of the upper nozzle portion of the dispensing pump.

Referring to FIGS. 2–5, the actuator 18 is also provided with three posts 42*a*, 42*b* (only two are shown) that respectively slide through openings 44 in the upper nozzle portion 22, as the actuator 18 moves up and down. However, as will be discussed in greater detail below, the posts 42 react against closure posts 46 of the closure 24 to prevent movement of the actuator when the dispensing pump 12 is in its closed position. In fact, FIG. 2 shows a configuration with the closure posts 46 preventing the actuator 18 from moving up and down, and FIG. 3 shows a second configuration with the closure posts 46 moved from the openings 44 in the upper nozzle portion 22 to permit the posts 42*a*, 42*b* of the actuator 18 therethrough.

The bellow 20 is attached to the upper nozzle portion 22 along the sealing ridge 48 of the upper nozzle portion 22 so as to be sealed thereto and create storage space 36. The pleats of the bellow 20 act as a spring which is used to return the actuator 18 and bellow 20 to the up position shown in FIG. 2 after pumping by the consumer. In fact, the internal spring of the bellow 20 acts to provide the necessary negative pressure (that is, suction) to draw fluid from the container body 14 while the actuator 18 and bellow 20 move upwardly during the return stroke of the dispensing pump 12.

The closure 24 of the dispensing pump 12 secures the dispensing pump 12 to the opening 16 in the container body 14. The closure 24 attaches to the container body 14 via threading 50 on the internal surface of the lower annular extension 52 of the closure 24.

Figure 5:
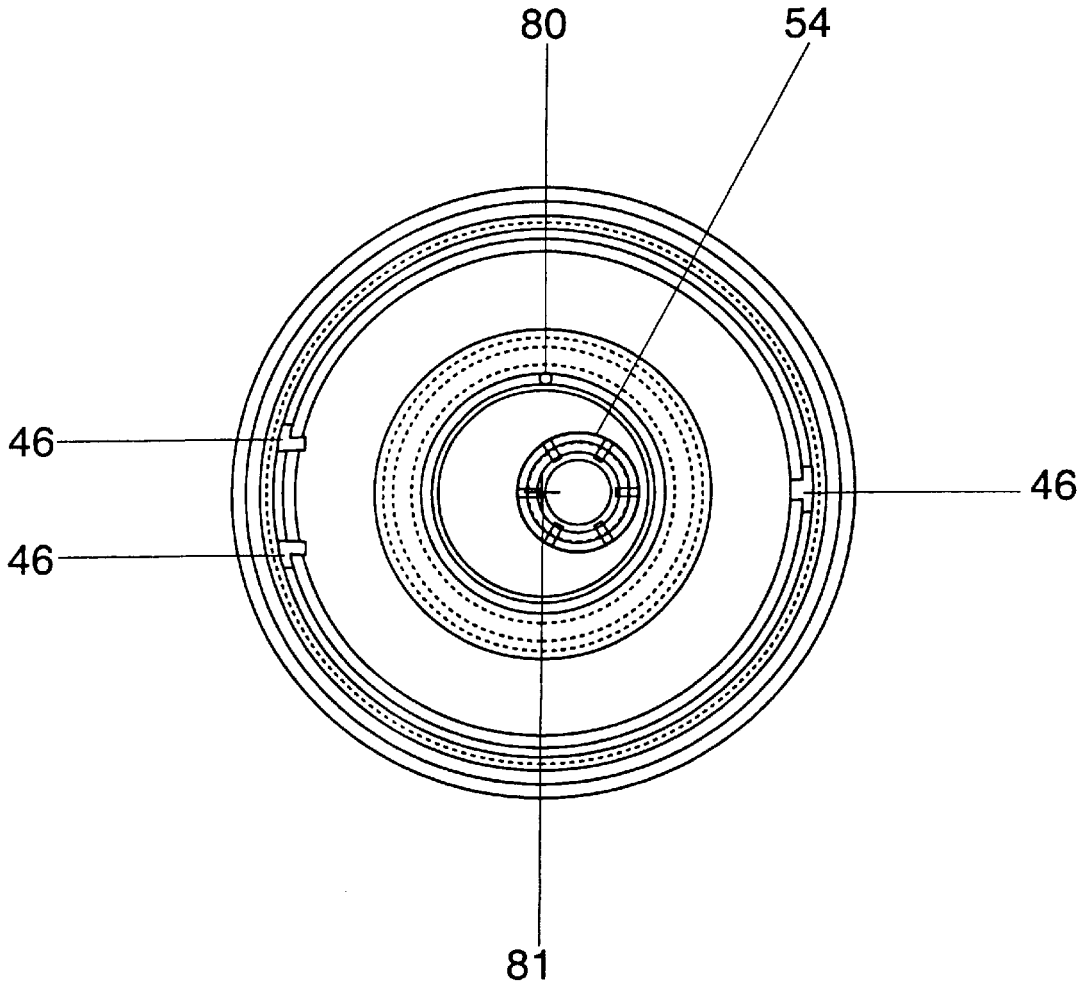
FIG. 5 is a top view of the closure of the dispensing pump.

The dispensing pump 12 is provided with an inlet valve 34 that seals against a valve seat 54 on the closure 24. The inlet valve 34 is prevented from freely floating in the bellow 20 by retaining arms 79 that limit the upward movement of the inlet valve. As shown in FIG. 5, the valve seat 54 is positioned off center for reasons that will become apparent when the invention is fully disclosed. The inlet valve 34 is in fluid communication with the storage space 36 defined by the bellow 20 such that fluid from the container body 14 is drawn up the dip tube 32, through the inlet valve 34 and into the storage space 36 defined by the bellow 20 when the bellow 20 moves from its compressed state to its expanded state. The inlet valve 34 is a one-way valve permitting the flow of material from the container body 14 to the storage space 36 defined by the bellow 20 and preventing the flow of material from the storage space 36 defined by the bellow 20 to the container 10 when positive pressure is applied by the bellow 20. As discussed above, the expansion of the bellow 20 between its compressed condition and its expanded condition is a result of the resilient characteristics of the bellow 20 itself. The resilient characteristics of the bellow are a result of being manufactured from plastic; eg, ethylene vinyl acetate is preferred.

The upper nozzle portion 22 is attached to the closure by interference of the nozzle attachment bead 56 and the closure bead 58. This arrangement permits rotational movement between the upper nozzle portion 22 and the closure 24.

The outlet hole 60 of the upper nozzle portion 22 provides a seat 62 to which the outlet valve 31 is attached. The outlet valve 31 may be a duckbill type valve, however, the outlet valve 31 may take on a variety of constructions while remaining within the spirit of the present invention. The upper nozzle portion 22 is also sealingly attached to the closure 24 by an inner seal bead 64 of the upper nozzle portion 22 that engages a closure sealing surface 66 of the closure 24. This seal prevents product leakage from the bellow 20.

Figure 6:
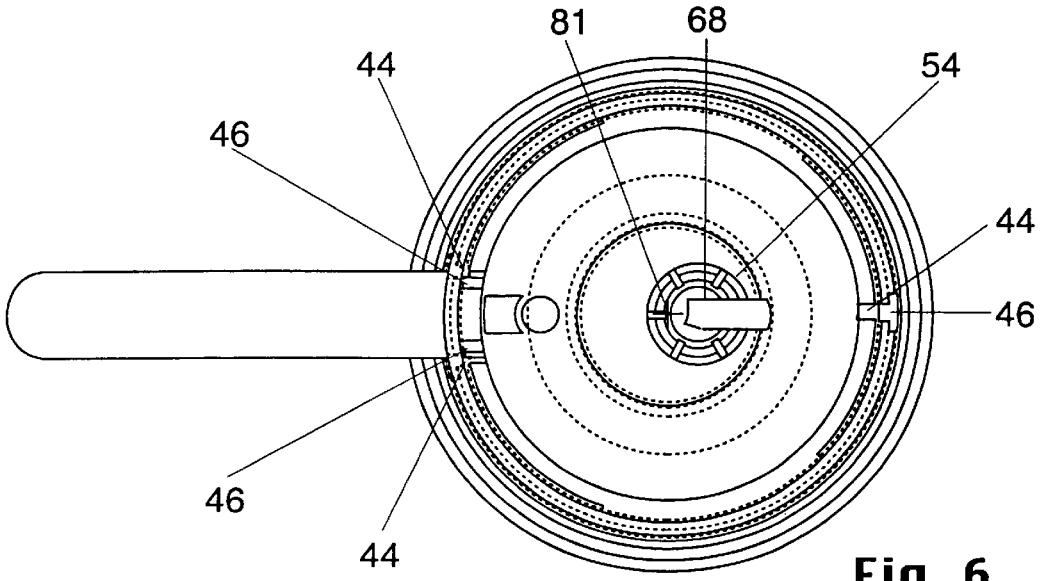
FIG. 6 is a cross-sectional view along the line VI—VI of FIG. 2.
Figure 7:
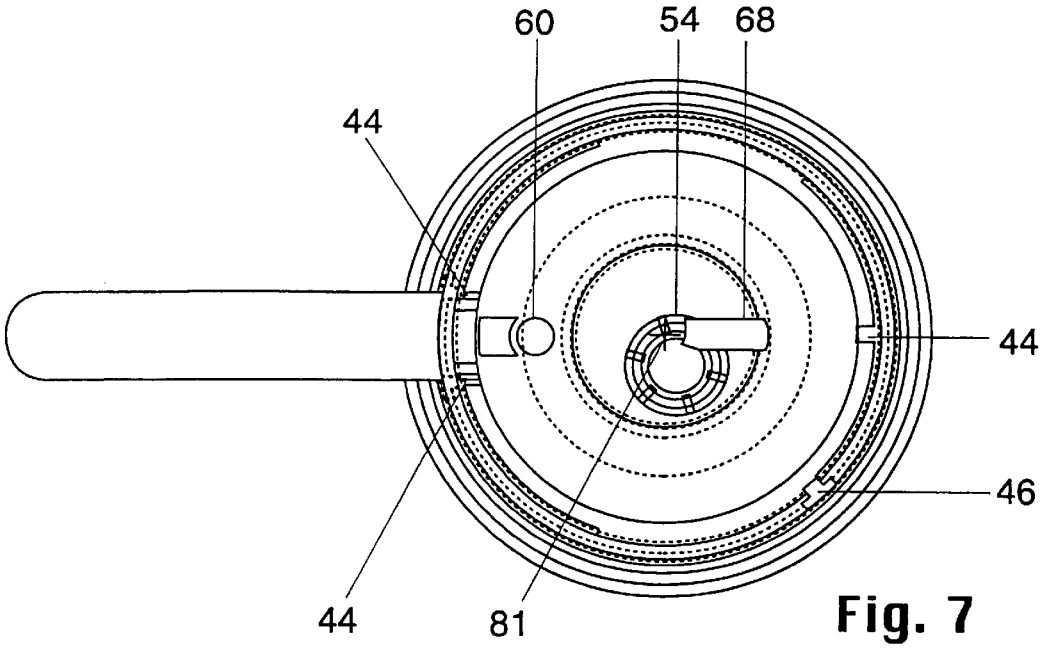
FIG. 7 is a cross-sectional view along the line VII—VII of FIG. 3.

The upper nozzle portion 22 is provided with a radial closure arm 68 that extends from the inner wall 70 of the upper nozzle portion 22. Briefly, with reference to FIGS. 2, 3, 6 and 7, the radial closure arm 68 is moveable between a first position (FIGS. 2 and 6) preventing the inlet valve 34 from opening and a second position (FIGS. 3 and 7) where the radial closure arm 68 is not a hinderance to the flow of material through the inlet valve 34. The radial closure arm 68 moves between the first position and the second position by rotating the dispensing pump 12, and in particular, the upper nozzle portion 22.

The radial closure arm 68 is structured such that when the dispensing pump 12 is in its closed position, the radial closure arm 68 extends over the inlet valve 34 and interferes with the flow of fluid through the inlet valve 34. The interference of the radial closure arm 68 with the inlet valve 34 forces the inlet valve 34 closed to prevent fluid communication with the dispensing pump 12. When the dispensing pump 12 is rotated to its open configuration, the radial closure arm 68 is moved away from the inlet valve 34 and does not impede the flow of material through the inlet valve 34.

The construction of the dispensing pump 12 is completed by the attachment of the lower nozzle portion 26 to the upper nozzle portion 22 to form a nozzle with outlet channel 30. The upper nozzle portion 22 and the lower nozzle portion 24 are coupled by engagement of a snap groove 72 on the lower nozzle portion 26 and a snap ridge 74 on the upper nozzle portion 22. The snap groove 72 and the snap ridge 74 create a tight seal to form the outlet channel 30 of the dispensing pump 12. The outlet channel 30, or product channel, extends from the outlet valve 31 to the nozzle valve 28. The upper and lower nozzle portions are secured together in a manner permitting them to rotate together as the closure arm 68 is moved between its opened and closed positions. The lower nozzle portion 26 is also provided with a lower nozzle portion bead 78 which engages the closure bead 58 to complete the rotational attachment between the upper and lower nozzle portions and the closure 24. The attachment of the lower nozzle portion 26 to the closure 24 is completed by positioning flange 77 of the lower nozzle portion 26 within the annular extension 52 of the closure 24.

The nozzle valve 28 sits in a nozzle hole 76 formed in the lower nozzle portion 26. The nozzle valve 28 prevents product from inadvertently dripping from the product outlet channel 30 during periods of non-use. It should be understood that the dispensing pump 12 does not require both the nozzle valve 28 and the outlet valve 31 in order to operate and that it may adequately operate with only one of said valves. However, the inclusion of both valves as shown in the preferred embodiment provides additional protection against dripping during non-use periods.

As stated above, the inlet valve 34 seals against the valve seat 54. The seat 54 is located off the central axis 81 of the closure 24. The dispensing pump 12, and particularly, the upper nozzle portion 22, rotate about the central axis 81. Since the valve seat 54 is located off center, the radial closure arm 68 passes over the inlet valve 34 as the upper nozzle portion 22 is rotated relative to the closure 24 (see FIGS. 2 and 6). However, the radial closure arm 68 only passes over the inlet valve 34 at a specific location, that is, the location at which the radial closure arm 68 contacts the inlet valve 34 to prevent the flow of fluid through the inlet valve 34.

When the dispensing pump 12, and in particular, the radial closure arm 68, are in the closed position, the vent hole 80 in the closure 24 is covered by the inner wall 70 of the upper nozzle portion 22. This prevents the flow of fluid from container body 14. As the dispensing pump 12 and radial closure arm 68 are rotated to the open position, the vent hole 80 is uncovered allowing air to enter the container 10 and equalize pressure inside the container with the atmosphere.

Now that the structural elements of the dispensing pump 12 have been set forth in detail, the operation of the dispensing pump 12 will be disclosed. When the dispensing pump 12 is in its open position and the storage space 36 has been filled with product as set forth below (see FIGS. 3 and 7), and an external force is applied to the actuator 18, fluid pressure builds inside the bellow 20 as the bellow 20 is compressed by the actuator 18. When the pressure has reached a sufficient level, the product forces the outlet valve 31 open and the product flows from the bellow 20, into the outlet channel 30, through the nozzle valve 28 and out of the dispensing pump 12.

On the return stroke of the actuator 18 and bellow 20, the outlet valve 31 and the nozzle valve 28 close, preventing fluid from passing into the bellow 20 from the outlet channel 30. The actuator 18 and the bellow 20 are then forced upwardly by the spring force of the bellow 20. This movement creates a vacuum (that is, negative pressure) in the storage space 36 defined by the bellow 20. The formation of the vacuum in the bellow 20 causes the inlet valve 34 to open, allowing product to flow from the container 10, through the dip tube 32 and into the bellow 20. When the actuator 18 reaches its uppermost position, the dispensing pump is recharged and ready for another dispensing stroke. That is, the spaced defined by the bellow is filled with product, which is ready to be forced out of the dispensing pump in the manner discussed above.

As discussed above, the radial closure arm 68 may be positioned on the inlet valve 34 to prevent the flow of product through the inlet valve 34 and into the bellow 20. When the dispensing pump 12 is in this closed position, the vent hole 80 is covered by the inner wall 70 of the upper nozzle portion 22. This prevents product from escaping from the container 10 in the closed position. When the dispensing pump 12 is placed in its open position, the inner wall 70 of the upper nozzle portion 22 rotates such that the vent hole 80 is uncovered, allowing air to pass into the container 10 to normalize the air pressure within the container 10.

In addition to preventing the flow of product through the inlet valve 34 when the dispensing pump 12 is closed, the actuator 18 is prevented from moving downwardly when the dispensing pump 12 is in its closed position. Specifically, the actuator 18 is prevented from moving downwardly by the closure posts 46 when the dispensing pump 12 is in its closed position. In the closed position, the closure posts 46 interfere with the openings 44 in the upper nozzle portion 22 to prevent the posts 42 on the actuator 18 from moving through the openings 44 in the upper nozzle portion 22. This prevents the actuator 18 from moving up and down. In the open position, the closure posts 46 are aligned so that they permit the posts 42 of the actuator 18 to slide through the openings 44 in the upper nozzle portion 22 and past the closure posts 46 in the closure 24. As a result, the dispensing pump 12, and particularly the actuator 18, are prevented from being compressed when the dispensing pump 12 is in its closed position. The bellow 20 is in its relaxed, uncompressed condition while the dispensing pump 12 is closed. Leaving the bellow 20 in its relaxed, uncompressed state prevents the permanent deformation that might occur if the bellow were to be locked in a compressed condition.

Figure 8:
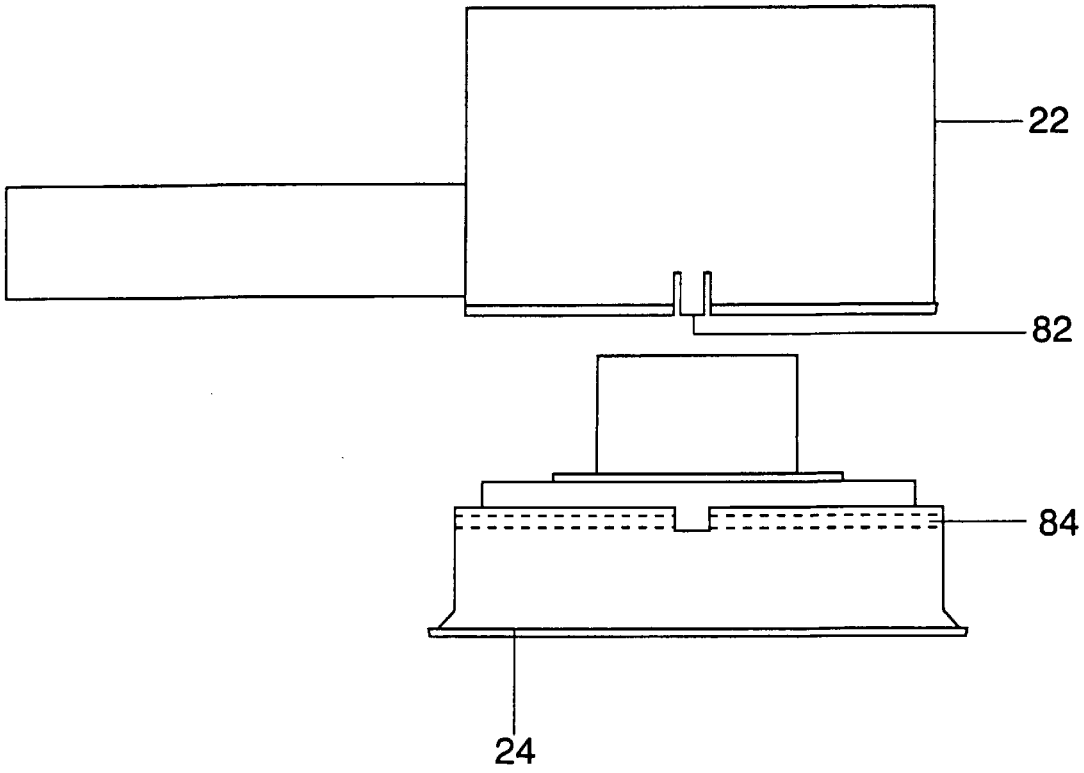
FIG. 8 is a side view of the dispensing pump showing a first embodiment of the child resistant lock.
Figure 9:
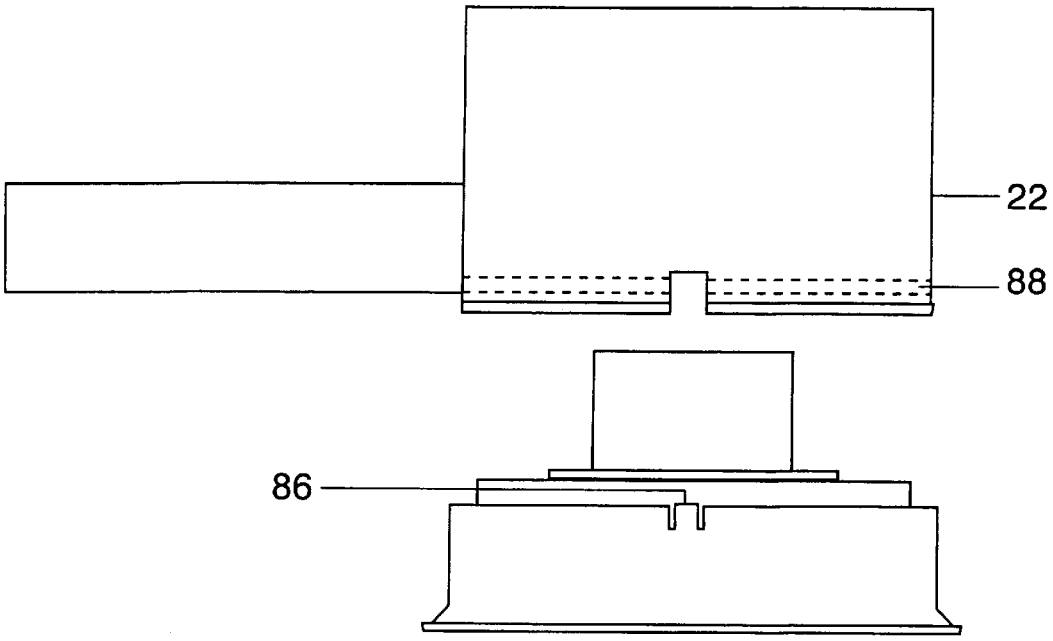
FIG. 9 is a side view of the dispensing pump showing a second embodiment of the child resistant lock.

The dispensing pump 12 is further provided with a child resistant lock. With reference to FIG. 8, the upper nozzle portion 22 is provided with child tabs 82 that fit into child grooves 84 on the closure 24. The child tabs 82 interact with the child grooves 84 such that rotation of the upper nozzle portion 22 relative to the closure 24 is prevented unless the tabs 82 are depressed to clear the child grooves 84 while torque is applied to rotate the upper nozzle portion 22. In this way, a child is prevented from rotating the upper nozzle portion 22 to move the dispensing pump 12 from its closed position to its open position. It should be understood that alternate embodiments of the child resistant lock assembly could be utilized without departing from the spirit of the present invention. For example, an alternate embodiment is disclosed in FIG. 9, where a child tab 86 is placed on the closure 24 and the child groove 88 is placed on the upper nozzle portion 22.

While the preferred embodiments have been shown and described, it will be understood that there is no intent to limit the invention by such disclosure, but rather, is intended to cover all modifications and alternate constructions falling within the spirit and scope of the invention as defined in the appended claims.

We claim:

1. A dispensing pump, comprising:

an actuator coupled to a resilient bellow, the bellow is in fluid communication with the contents of a container via an inlet valve such that expansion of the bellow, caused by the resilience of the bellow, creates negative pressure causing the contents of the container to be drawn through the inlet valve and into a space defined by the bellow;

an outlet valve in fluid communication with the bellow such that compression of the bellow caused by the application of pressure to the actuator creates positive pressure within the bellow causing the contents held within the bellow to be forced through the outlet valve and out of an outlet of the dispensing pump; and a closure arm mounted within the space defined by the bellow, the closure arm being moveable between a first position where the closure arm prevents the inlet valve from opening and a second position where the closure arm is not a hinderance to the flow of material through the inlet valve, said closure arm being moved between the first position and the second position by rotating the dispensing pump.

2. The dispensing pump according to claim 1, wherein the inlet valve is a one-way valve permitting the flow of material from the container to the space defined by the bellow and preventing the flow of material from the space defined by the bellow to the container when positive pressure is applied by the bellow.

3. The dispensing pump according to claim 1, wherein the outlet valve is a pressure responsive one-way valve permitting the flow of material from the space defined by the bellow through the outlet valve and to the outlet of the dispensing pump when a predetermined positive pressure is reached in the space defined by the bellow.

4. The dispensing pump according to claim 1, wherein said dispensing pump rotates about a central axis, and wherein said inlet valve is located off of said central axis.

5. The dispensing pump according to claim 1, wherein said dispensing pump may be locked with said bellow in a relaxed state.

6. The dispensing pump according to claim 1, further including a lock preventing movement of the closure arm between the first position and the second position.

7. A container, comprising:

a body for storing materials therein, the body having a pump dispenser secured thereto;

the pump dispenser includes;

an actuator coupled to a resilient bellow, the bellow is in fluid communication with the contents of a container via an inlet valve such that expansion of the bellow creates negative pressure causing the contents of the container to be drawn through the inlet valve and into a space defined by the bellow;

an outlet valve in fluid communication with the bellow such that compression of the bellow caused by the application of pressure to the actuator creates positive pressure within the bellow causing the contents held within the bellow to be forced through the outlet valve and out of an outlet of the dispenser; and a closure arm mounted within the space defined by the bellow, the closure arm being moveable between a first position where the closure arm prevents the inlet valve from opening and a second position where the closure arm is not a hinderance to the flow of material through the inlet valve, said closure arm being moved between the first position and the second position by rotating the pump dispenser.

8. The container according to claim 7, wherein the inlet valve is a one-way valve permitting the flow of material from the container to the space defined by the bellow and preventing the flow of material from the space defined by the bellow to the container when positive pressure is applied by the bellow.

9. The container according to claim 7, wherein the outlet valve is a pressure responsive one-way valve permitting the flow of material from the space defined by the bellow through the outlet valve and to the outlet of the dispensing pump when a predetermined positive pressure is reached in the space defined by the bellow.

10. The container according to claim 7, further including a lock preventing movement of the closure arm between the first position and the second position.

11. The container according to claim 7, wherein said dispensing pump is secured to said body by a closure having a vent hole, said vent hole being closed when said closure arm is in said first position and being open when said closure arm is in said second position.

12. A dispensing pump, comprising:

an actuator in fluid communication with the contents of a container via an inlet valve such that a first movement of the actuator creates negative pressure to cause the contents of the container to be drawn through the inlet valve and into a storage space;

an outlet valve in fluid communication with the storage space such that a second movement of the actuator creates positive pressure to cause the contents held within the storage space to be forced through the outlet valve and out of the dispensing pump; and a closure arm mounted within the storage space, the closure arm being moveable between a first position where the closure arm prevents the inlet valve from opening and a second position where the closure arm is not a hinderance to the flow of material through the inlet valve, said closure arm being moved between the first position and the second position by rotating the dispensing pump.

13. The dispensing pump according to claim 12, further including means for preventing downward movement of the actuator when the closure arm is in the first position.

14. The dispensing pump according to claim 12, further including a lock preventing movement of the closure arm between the first position and the second position.

15. The dispensing pump according to claim 12, wherein said dispensing pump rotates about a central axis, and wherein said inlet valve is located off of said central axis.

16. The dispensing pump according to claim 12, wherein said dispensing pump may be locked so as to prevent downward movement of said actuator.

17. A container, comprising:

a body for storing materials therein, the body having a pump dispenser secured thereto;

the pump dispenser includes;

an actuator in fluid communication with the contents of a container via an inlet valve such that a first movement of the actuator creates negative pressure to cause the contents of the container to be drawn through the inlet valve and into a storage space;

an outlet valve in fluid communication with the storage space such that a second movement of the actuator creates positive pressure to cause the contents held within the storage space to be forced through the outlet valve and out of the dispenser; and a closure arm mounted within the storage space, the closure arm being moveable between a first position where the closure arm prevents the inlet valve from opening and a second position where the closure arm is not a hinderance to the flow of material through the inlet valve, said closure arm being moved between the first position and the second position by rotating the pump dispenser.

18. The container according to claim 17, further including means for preventing downward movement of the actuator when the closure arm is in the first position.

19. The container according to claim 18, further including a lock preventing movement of the closure arm between the first position and the second position.

20. The container according to claim 17, wherein said dispensing pump is secured to said body by a closure having a vent hole, said vent hole being closed when said closure arm is in said first position and being open when said closure arm is in said second position.

* * * * *